US006398231B1

(12) United States Patent
Colonese

(10) Patent No.: US 6,398,231 B1
(45) Date of Patent: Jun. 4, 2002

(54) ROLLER SKATE WITH ANGLED WHEELS

(75) Inventor: Joseph Colonese, Colorado Springs, CO (US)

(73) Assignee: V-Formation, Inc., Lincoln Park, NJ (US)

( * ) Notice: Subject to any disclaimer, the term of this patent is extended or adjusted under 35 U.S.C. 154(b) by 0 days.

(21) Appl. No.: 09/730,318

(22) Filed: Dec. 4, 2000

(51) Int. Cl.[7] ..... A63C 17/06
(52) U.S. Cl. ..... 280/11.223; 280/11.232
(58) Field of Search ..... 280/11.223, 841, 280/11.19, 11.221, 11.231, 11.232, 11.233, 11.3, 11.17

(56) References Cited

U.S. PATENT DOCUMENTS 4,382,605 A * 5/1983 Hegna ..... 280/11.22
5,192,088 A * 3/1993 Yu ..... 280/11.22
5,199,727 A * 4/1993 Lai ..... 280/11.28
5,303,940 A * 4/1994 Brandner ..... 280/11.22
5,566,957 A * 10/1996 Ho ..... 280/11.22
5,732,957 A * 3/1998 Yu ..... 280/11.19
6,003,882 A * 12/1999 Colonese, Jr. et al. ... 280/11.22
6,068,268 A * 5/2000 Cornelius et al. ..... 280/11.22
6,161,846 A * 12/2000 Soderberg ..... 280/11.225
6,173,975 B1 * 1/2001 Brandner ..... 280/11.22
6,186,518 B1 * 2/2001 Moses ..... 280/11.225
6,273,437 B1 * 8/2001 Lovitt et al. ..... 280/11.223

* cited by examiner

*Primary Examiner*—J. J. Swann
*Assistant Examiner*—J. Allen Shriver
(74) *Attorney, Agent, or Firm*—Mark G. Pannell; Hanes & Schutz, P.C.

(57) ABSTRACT

A roller skate includes at least one mounting plate affixed or integral to an article of footwear, a bilateral frame, a plurality of axles, and a plurality of wheels. The bilateral frame is affixed to each mounting plate. The frame also includes a plurality of axle journals angularly disposed to one another. A plurality of axles are supported at each end by one of the axle journals. At least one of the axles is nonparallel to at least another one of the axles. A plurality of wheels are disposed upon the axles.

20 Claims, 2 Drawing Sheets

ROLLER SKATE WITH ANGLED WHEELS

FIELD OF THE INVENTION

This invention relates in general to roller skates and, more particularly, to roller skates having wheels disposed at an angle.

BACKGROUND OF THE INVENTION

Inline roller skates have long been known. The wheels of the inline skates are arranged in tandem and disposed in a common plane. The tandem wheels disposed in a common plane cause the skate to travel in a straight line. In order to turn the skate, the skater must lean the skate, causing the wheels to lose some traction with the skating surface and slide. The more the wheels lean, the less traction they have on the skating surface. The reduced traction causes the wheels to slip. As the wheels slip, the skate turns.

Within the past few years, roller skates have been produced where the wheels are arranged in tandem, but not disposed in a common plane. Typically, the wheels of these skates are arranged in alternately angled directions. For instance, one front wheel and one rear wheel are angled to the left and the other wheels are angled right. This arrangement is sometimes called a v-line skate.

When a skater with v-line skates leans the skates over to turn, those wheels angled in the direction of the turn become closer to horizontal with the skating surface than would like wheels in a standard inline skate. Those wheels angled opposite the direction of turn remain more upright than like wheels in a standard inline skate. This action greatly improves turning and maneuverability.

In the sport of inline hockey, there is a great desire to improve the maneuverability and to make the skate perform more like an ice Hockey skate. The V-line or angled wheels do exactly that. They improve turning and make the skate feel more like a person is on ice.

The V-line type frames that are currently being used work well, but they are lacking in many respects over other skates. Conventional v-line skates support the wheel axles from only one side. Furthermore, each of the wheels is supported independently of the others. Both of these issues result in a heavy skate that is weak and lacking in stiffness.

Stiffness is important to skaters because a stiffer skate greatly improves acceleration and speed by transferring more energy to the skating surface. Conventional v-line skates lose stiffness by supporting the axle on only one side and by supporting each axle independently.

Conventional v-line skates are also structurally weak because the axles are supported from only one side. This causes the skate to be weaker and more prone to breaking. In order to compensate for this weakness, thicker material is used for the skate axle. The thicker material results in a heavier skate.

Skaters often lift their skates hundreds or even thousands of times a day. A heavy skate may cause the skater to become fatigued. Lighter skates would cause less fatigue. Additionally, lighter skates enable the skater to accelerate faster.

Many conventional v-line skates also require special wheels. As wheels tend to wear out, it would be more convenient for a skate to use standardly available wheels.

SUMMARY OF THE INVENTION

According to principles of the present invention, a roller skate includes at least one mounting plate affixed or integral to an article of footwear, a bilateral frame, a plurality of axles, and a plurality of wheels. The bilateral frame is affixed to each mounting plate. The frame also includes a plurality of axle journals angularly disposed to one another. A plurality of axles are supported at each end by one of the axle journals. At least one of the axles is nonparallel to at least another one of the axles. A plurality of wheels are disposed upon the axles.

DETAILED DESCRIPTION OF THE INVENTION

Figure 1:
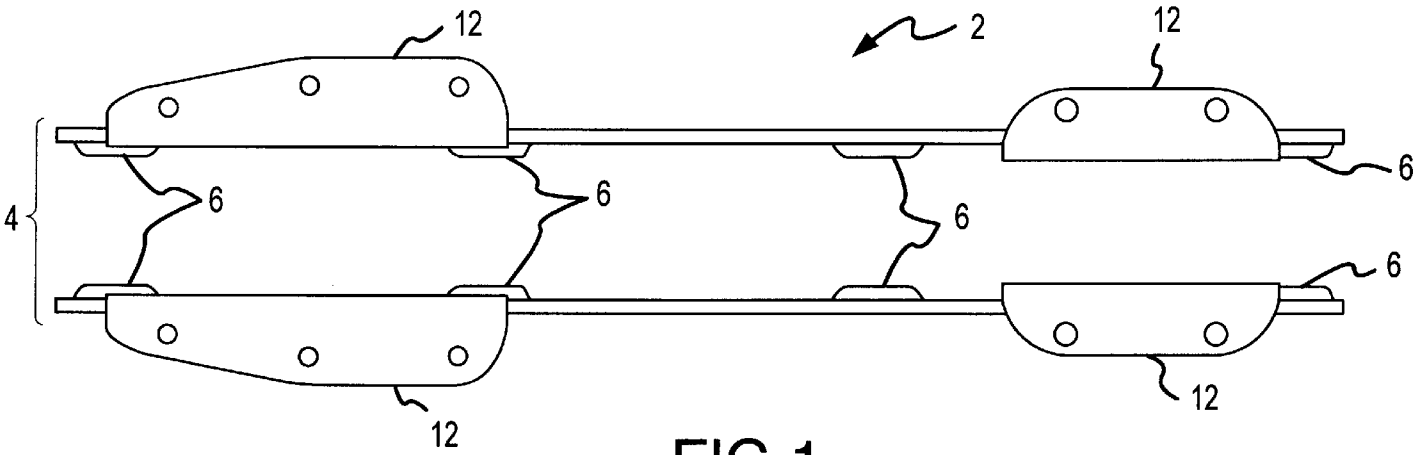
FIG. 1 is a top elevation of one embodiment of a skate undercarriage of the present invention.
Figure 2:
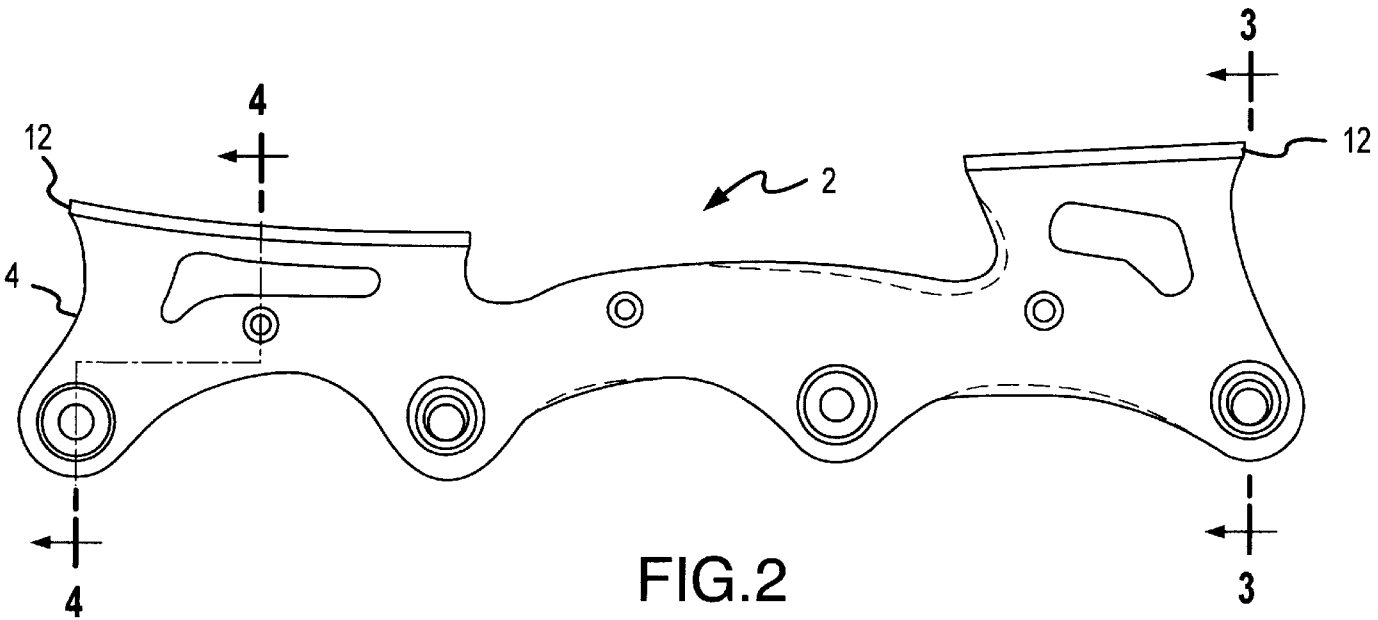
FIG. 2 is a side elevation of the skate undercarriage shown in FIG. 1.

Referring to FIGS. 1–4, an undercarriage 2 is shown for skates. Undercarriage 2 includes a bilateral frame 4 having a plurality of axle journal pairs 6. Axle journal pairs 6 may be evenly or unevenly spaced along bilateral frame 4.

Bilateral frame 4 is constructed from any suitable material, such as a rigid, lightweight metal. Bilateral frame 4 is similar to a conventional inline skate bilateral frame except for the configuration of axle journal pairs 6. Bilateral frame 4 is disposed about longitudinal axis 5. Spaced apart side members 7 are disposed bilaterally at longitudinal axis 5.

Figure 3:
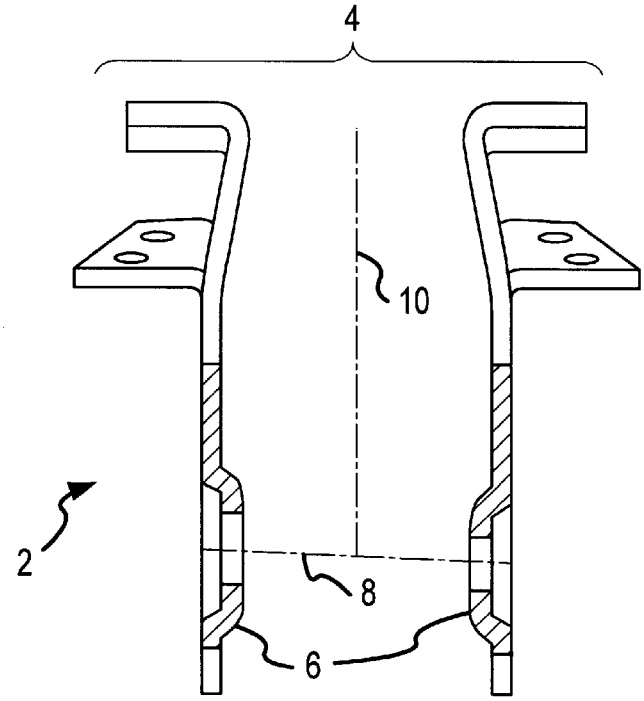
FIG. 3 is a first cross section through A—A of the skate undercarriage shown in FIG. 1.
Figure 4:
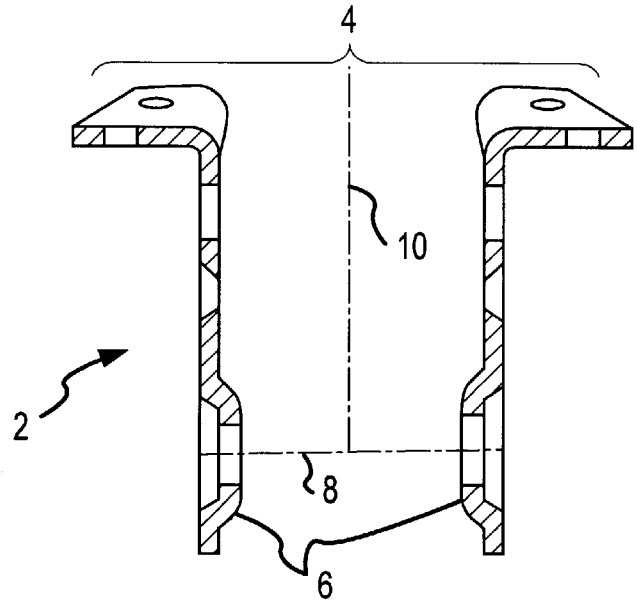
FIG. 4 is a second cross section through B—B of the skate undercarriage shown in FIG. 1.
Figure 1:
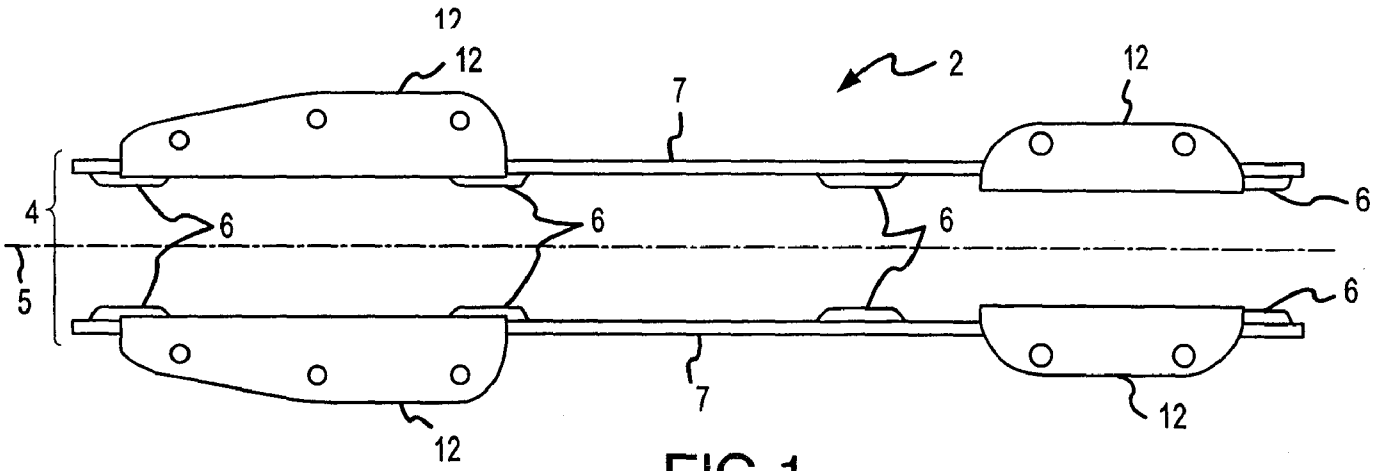
Figure 2:
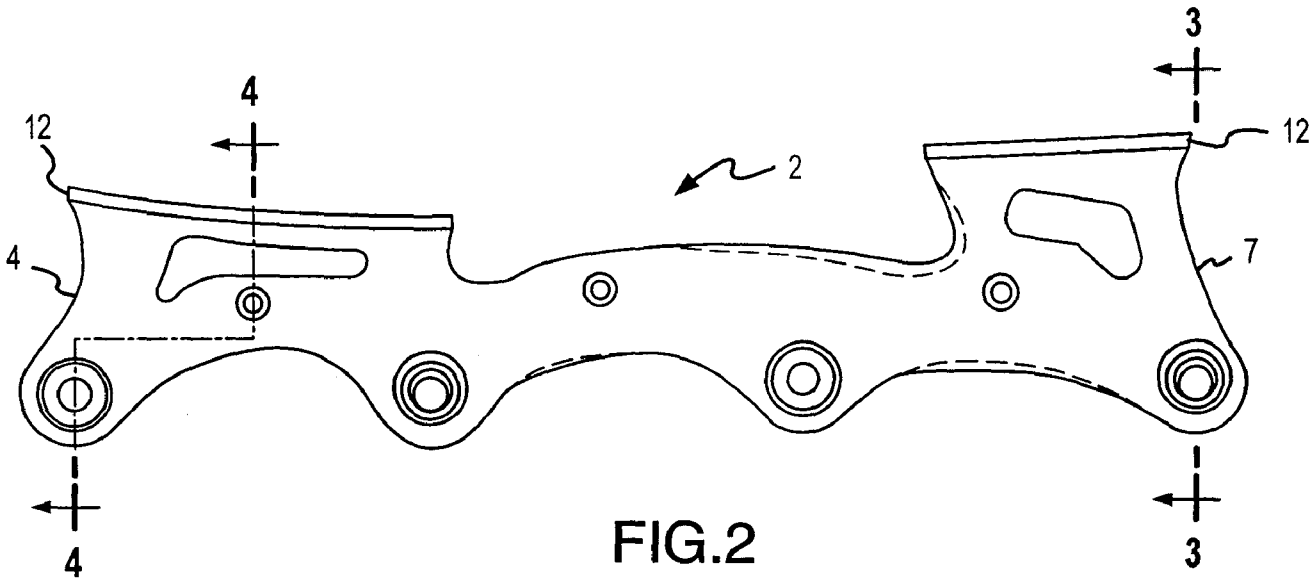
Figure 3:
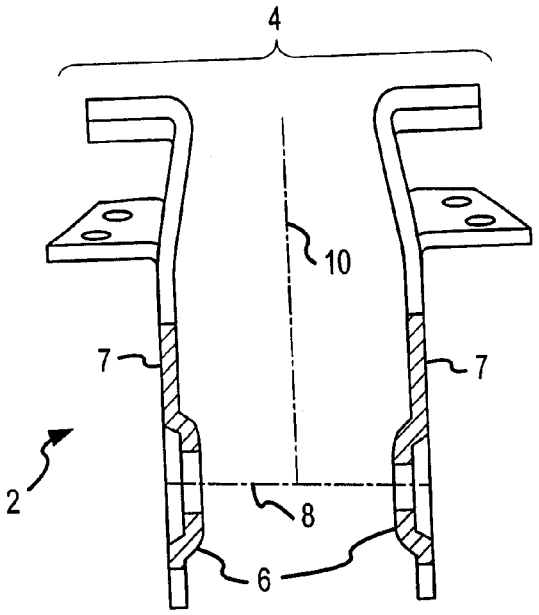
Figure 4:
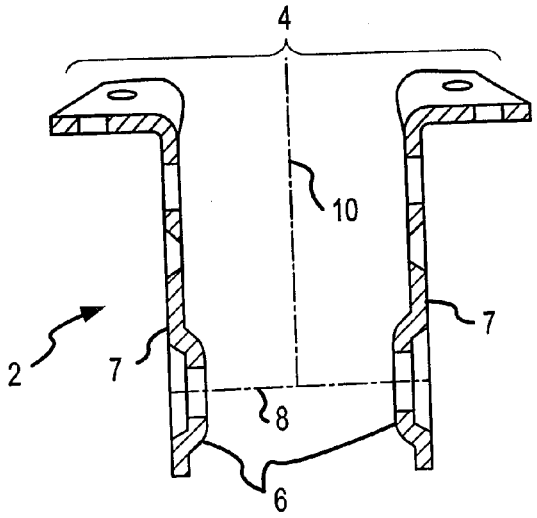

Each axle journal pair 6 is aligned on an axis 8. At least one of the axes 8 is nonparallel to at least another one of the axes 8. FIGS. 3 and 4 illustrate nonparallel axes 8. A reference line 10 is shown perpendicular to a skating surface (not shown). Axis 8 shown in FIG. 3 is angled relative to line 10 such that at the intersection of axes 8 and line 10, the left side (as shown) is less than ninety degrees and the right side (as shown) is greater than ninety degrees. In some embodiments, the intersection of axes 8 and line 10 is between about one and about ten degrees. Axis 8 shown in FIG. 4 is angled relative to line 10 such that at the intersection of axes 8 and line 10. the left side (as shown) is greater than ninety degrees and the right side (as shown) is less than ninety degrees.

In an example to further illustrate the angled relationship of axes 8, axis 8 in FIG. 3 is tilted two degrees to the right and axis 8 in FIG. 4 is tilted two degrees to the left, both relative to line 10. The angled relationship between axis 8 in FIG. 3 and axis 8 in FIG. 4 would then be four degrees from parallel.

Each axle journal pair 6 supports an axle (not shown). The axles are supported at each end by one of the pair 6 of axle journals. Wheels (not shown) are disposed about each axle. The wheels are arranged to roll in a uniform direction upon a skating surface. In one embodiment, at the point of contact with the skating surface, the wheels are aligned.

Undercarriage 2 may be mounted to a base such as the sole of an article of footwear or mounting plates 12. Mounting plates 12 are affixed to bilateral frames 4. Mounting plates 12 enable mounting of undercarriage 2 to an article of footwear, such as a rigid skating boot.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. An undercarriage for a roller skate, the undercarriage comprising a bilateral frame disposed about a longitudinal axis, the bilateral frame having a plurality of axle journal pairs, each pair aligned a transverse axis, at least a first one of the transverse axes nonparallel to at least a second one of the transverse axes, wherein at least the first one of the transverse axes is angularly disposed with respect to at least the second one of the transverse axes in a projection of at least the first and second one of the transverse axes on a plane perpendicular to the longitudinal axis.

2. The undercarriage of claim 1 further including a plurality of axles, each axle having a first end and a second end, at least a first one of the axles nonparallel to at least a second one of the axles, each axle supported by one of the pairs of axle journals at the first and second ends of the axle.

3. The undercarriage of claim 1 wherein the axle journal pairs are equally spaced along the bilateral frame.

4. The undercarriage of claim 1 wherein the axle journal pairs are unequally spaced along the bilateral frame.

5. The undercarriage of claim 1 wherein the first axis is disposed relative to the at least second axis at an angle of between about one and about ten degrees.

6. A roller skate comprising:

(a) at least one mounting plate;

(b) a bilateral frame disposed about a longitudinal axis and affixed to each mounting plate, the bilateral frame having a plurality of axle journal pairs, and (c) a plurality of axles, each axle having a first end and a second end, at least a first one of the axles nonparallel to at least a second one of the axles, at least the first one of the axles angularly disposed with respect to at least the second one of the axles in a projection of at least the first and second axles on a plane perpendicular to the longitudinal axis, each axle supported by one of the axle journal pairs at the first and second ends of the axle; and, (d) a plurality of wheels, each wheel disposed upon one of the axles between the first end and the second end of the axle.

7. The roller skate of claim 6 further including an article of footwear and wherein each mounting plate is affixed to the article footwear.

8. The roller skate of claim 6 further including an article of footwear and wherein each mounting plate is integral to the article of footwear.

9. The roller skate of claim 6 wherein the wheels are equally spaced within the bilateral frame.

10. The roller skate of claim 6 wherein the wheels are unequally spaced within the bilateral frame.

11. The roller skate of claim 6 wherein the first axle is disposed relative to the at least second axle at an angle of between about one and about ten degrees.

12. A roller skate comprising:

(a) at least one mounting plate;

(b) a bilateral frame disposed about a longitudinal axis, the bilateral frame affixed to each mounting plate and having a plurality of axle journal pairs each pair aligned on a transverse axis, at least a first one of the transverse axes nonparallel to at least a second one of the transverse axes, wherein at least the first one of the transverse axes is angularly disposed with respect to at least the second one of the transverse axes in a projection of at least the first and second one of the transverse axes on a plane perpendicular to the longitudinal axis;

(c) a plurality of axles, each axle having a first end and a second end, each axle supported by one of the axle journal pairs at the first and second ends of the axle; and, (d) a plurality of wheels, each wheel disposed upon one of the axles between the first end and the second end of the axle.

13. The roller skate of claim 12 further including an article of footwear and wherein each mounting plate is affixed to the article footwear.

14. The roller skate of claim 12 further including an article of footwear and wherein each mounting plate is integral to the article of footwear.

15. The roller skate of claim 12 wherein the wheels are equally spaced within the bilateral frame.

16. The roller skate of claim 12 wherein the wheels are unequally spaced within the bilateral frame.

17. The roller skate of claim 12 wherein the first axle is disposed relative to the at least second axle at an angle of between about one and about ten degrees.

18. An undercarriage for a roller skate, the undercarriage comprising a frame having spaced apart side members disposed bilaterally of a longitudinal axis, the frame having a like plurality of axle journals in each of the side members wherein axes interconnecting pairs of axle journals in the respective side members are v non-parallel with respect to one another in a projection of the axes interconnecting pairs of axle journals on a plane perpendicular to the longitudinal axis.

19. The undercarriage of claim 18 further including a plurality of axles, each axle having a first end and a second end, at least a first one of the axles nonparallel to at least a second one of the axles, each axle supported by one of the pairs of axle journals at the first and second ends of the axle.

20. The undercarriage of claim 18 wherein the first axis is disposed relative to the at least second axis at an angle of between about one and about ten degrees.

* * * * *

UNITED STATES PATENT AND TRADEMARK OFFICE

CERTIFICATE OF CORRECTION

PATENT NO. : 6,398,231 B1
DATED : June 6, 2002
INVENTOR(S) : Joseph Colonese

It is certified that error appears in the above-identified patent and that said Letters Patent is hereby corrected as shown below:

The title page should be deleted to appear as per attached title page.

Drawings,
The sheet of drawings consisting of figures 1-4 should be deleted to appear as per attached figures.

Signed and Sealed this

Tenth Day of September, 2002

*Attest:*

*Attesting Officer*

JAMES E. ROGAN
*Director of the United States Patent and Trademark Office*

(12) United States Patent
Colonese

(10) Patent No.: US 6,398,231 B1
(45) Date of Patent: Jun. 4, 2002

(54) ROLLER SKATE WITH ANGLED WHEELS

(75) Inventor: Joseph Colonese, Colorado Springs, CO (US)

(73) Assignee: V-Formation, Inc., Lincoln Park, NJ (US)

( * ) Notice: Subject to any disclaimer, the term of this patent is extended or adjusted under 35 U.S.C. 154(b) by 0 days.

(21) Appl. No.: 09/730,318

(22) Filed: Dec. 4, 2000

(51) Int. Cl.[7] ..... A63C 17/06
(52) U.S. Cl. ..... 280/11.223; 280/11.232
(58) Field of Search ..... 280/11.223, 841, 280/11.19, 11.221, 11.231, 11.232, 11.233, 11.3, 11.17

(56) References Cited

U.S. PATENT DOCUMENTS 4,382,605 A * 5/1983 Hegna ..... 280/11.22
5,192,088 A * 3/1993 Yu ..... 280/11.22
5,199,727 A * 4/1993 Lai ..... 280/11.28
5,303,940 A * 4/1994 Brandner ..... 280/11.22
5,566,957 A * 10/1996 Ho ..... 280/11.22
5,732,957 A * 3/1998 Yu ..... 280/11.19
6,003,882 A * 12/1999 Colonese, Jr. et al. ... 280/11.22
6,068,268 A * 5/2000 Cornelius et al. ..... 280/11.22
6,161,846 A * 12/2000 Soderberg ..... 280/11.225
6,173,975 B1 * 1/2001 Brandner ..... 280/11.22
6,186,518 B1 * 2/2001 Moses ..... 280/11.225
6,273,437 B1 * 8/2001 Lovitt et al. ..... 280/11.223

* cited by examiner

*Primary Examiner*—J. J. Swann
*Assistant Examiner*—J. Allen Shriver
(74) *Attorney, Agent, or Firm*—Mark G. Pannell; Hanes & Schutz, P.C.

(57) ABSTRACT

A roller skate includes at least one mounting plate affixed or integral to an article of footwear, a bilateral frame, a plurality of axles, and a plurality of wheels. The bilateral frame is affixed to each mounting plate. The frame also includes a plurality of axle journals angularly disposed to one another. A plurality of axles are supported at each end by one of the axle journals. At least one of the axles is nonparallel to at least another one of the axles. A plurality of wheels are disposed upon the axles.

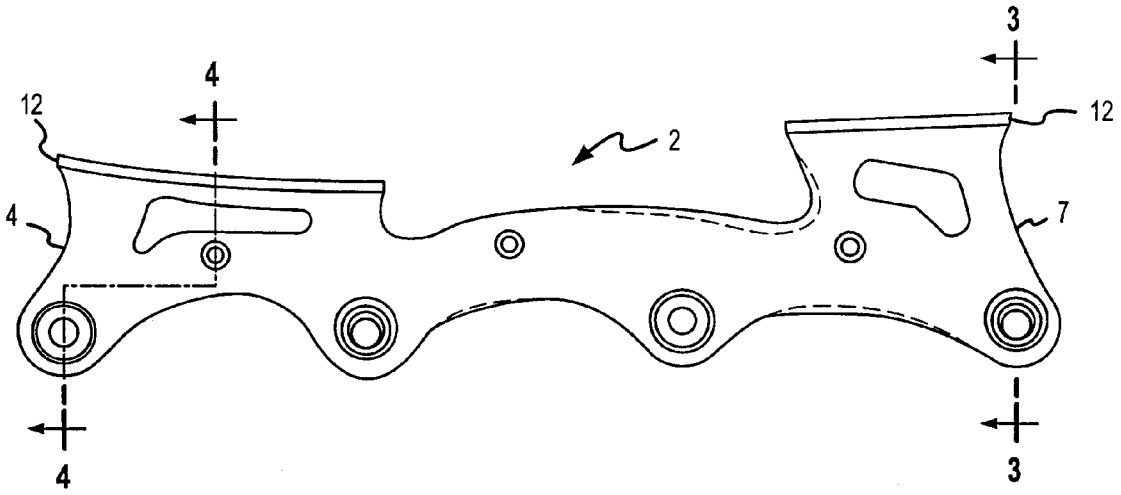

20 Claims, 2 Drawing Sheets